US011504555B2

(12) United States Patent
Zimmer

(10) Patent No.: US 11,504,555 B2
(45) Date of Patent: Nov. 22, 2022

(54) BREATHING FILTER ASSEMBLY

(71) Applicant: Robert Zimmer, Garfield Hts, OH (US)

(72) Inventor: Robert Zimmer, Garfield Hts, OH (US)

( * ) Notice: Subject to any disclaimer, the term of this patent is extended or adjusted under 35 U.S.C. 154(b) by 241 days.

(21) Appl. No.: 17/003,196

(22) Filed: Aug. 26, 2020

(65) Prior Publication Data

US 2022/0062672 A1 Mar. 3, 2022

(51) Int. Cl.
*A62B 23/00* (2006.01)
*A62B 23/06* (2006.01)

(52) U.S. Cl.
CPC ..... *A62B 23/00* (2013.01); *A62B 23/06* (2013.01)

(58) Field of Classification Search
CPC ..... A62B 23/00; A62B 23/06; A62B 9/00; A62B 9/06; A62B 7/00; A62B 7/10; A41D 13/11; A41D 13/1107; A61M 29/00; A61F 5/08
See application file for complete search history.

(56) References Cited

U.S. PATENT DOCUMENTS 1,520,930 A * 12/1924 Calhoun ..... A62B 23/06 24/3.13
2,439,855 A * 4/1948 Mortensen ..... A61F 5/56 128/206.11
5,603,317 A * 2/1997 Farmer ..... A41D 13/1146 128/206.28
7,543,584 B2 6/2009 Brookman
2003/0154983 A1 8/2003 Mars
2006/0137689 A1* 6/2006 Evensson ..... A62B 23/06 128/205.27
2006/0225738 A1* 10/2006 Afentoulopoulos ..... A62B 7/10 128/207.29
2007/0163588 A1 7/2007 Hebrank
2010/0108071 A1 5/2010 Macy, Jr.
2015/0083121 A1 3/2015 Fisher
2015/0258355 A1* 9/2015 Folkvord ..... A62B 7/10 128/205.29
2019/0247682 A1* 8/2019 Sutherland ..... A62B 9/02
2019/0374797 A1* 12/2019 Jones ..... A62B 18/10
2022/0016376 A1* 1/2022 Lamoncha ..... A61M 16/0672

FOREIGN PATENT DOCUMENTS

WO WO2011050626 5/2011

* cited by examiner

*Primary Examiner* — Colin W Stuart

(57) ABSTRACT

A breathing filter assembly for filtering breathing air includes a breathing unit that includes a mouthpiece that can be placed in a user's mouth. The breathing unit includes a pair of nose tubes that can each be positioned in a respective one of the user's nostrils when the mouthpiece is positioned in the user's mouth. A filter is removably insertable into the breathing unit. The filter is made of an air permeable material to pass air therethrough for breathing. The filter extends into the mouthpiece and each of the nose tubes to filter air inhaled through the user's mouth or the user's nose.

11 Claims, 5 Drawing Sheets

BREATHING FILTER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to breathing devices and more particularly pertains to a new breathing device for filtering breathing air.

(2) Description of Related Art Including Information Disclosed Under 37 CFR 1.97 and 1.98

The prior art relates to breathing devices including an air filtering mask that includes a pair elastic straps. The prior art discloses a respirator that includes a face mask and a remote filtering unit that supplies filtered air to the face mask for breathing. The prior art discloses an air filter that is wearable on a user's face and which extends into the user's nostrils for filtering air breathed through the nostrils.

BRIEF SUMMARY OF THE INVENTION

An embodiment of the disclosure meets the needs presented above by generally comprising a breathing unit that includes a mouthpiece that can be placed in a user's mouth. The breathing unit includes a pair of nose tubes that can each be positioned in a respective one of the user's nostrils when the mouthpiece is positioned in the user's mouth. A filter is removably insertable into the breathing unit. The filter is comprised of an air permeable material to pass air therethrough for breathing. The filter extends into the mouthpiece and each of the nose tubes to filter air inhaled through the user's mouth or the user's nose.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
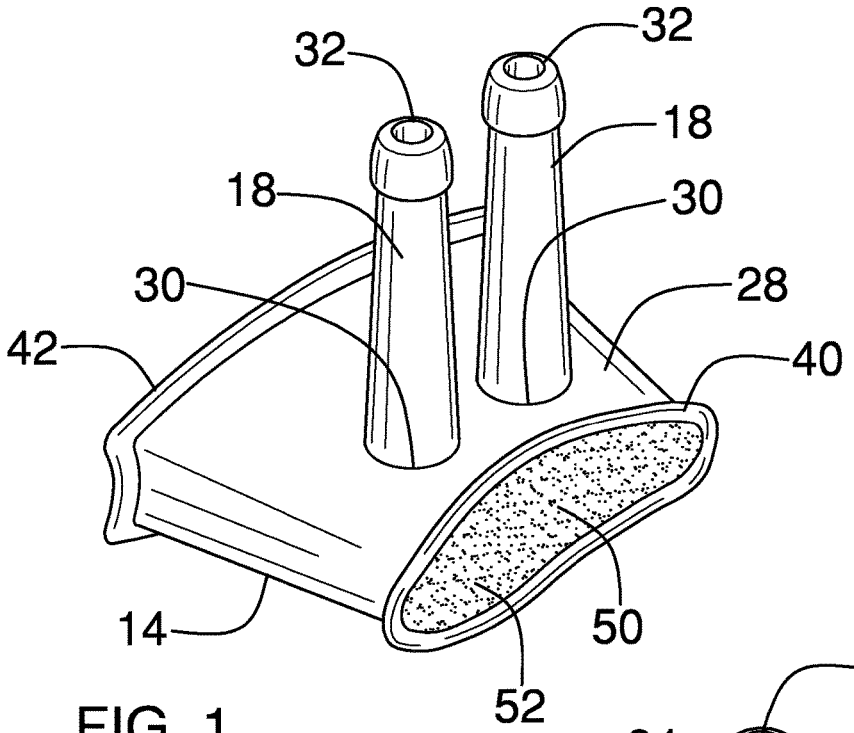
FIG. 1 is a top perspective view of a breathing filter assembly according to an embodiment of the disclosure.
Figure 2:
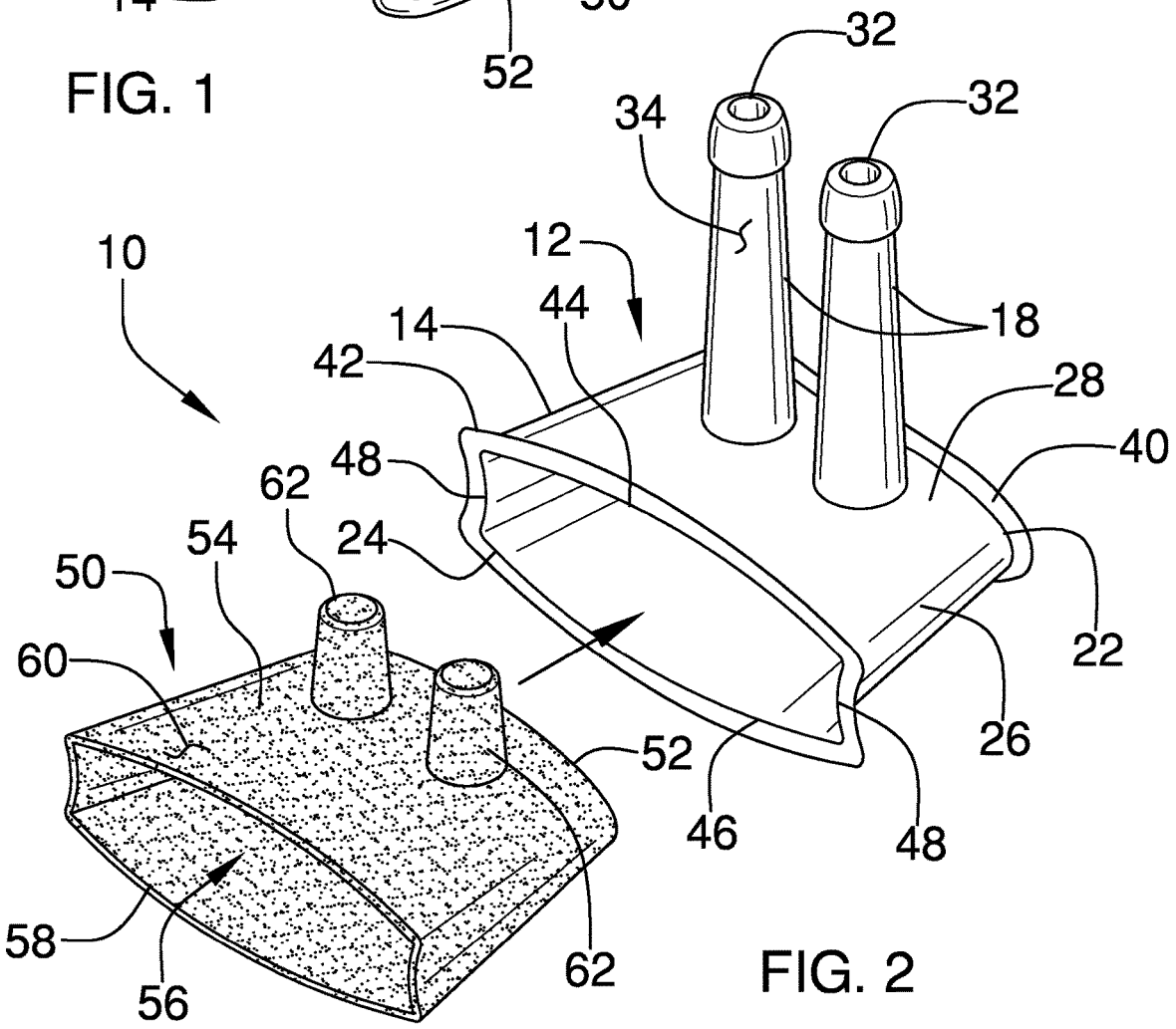
FIG. 2 is an exploded perspective view of an embodiment of the disclosure.
Figure 3:
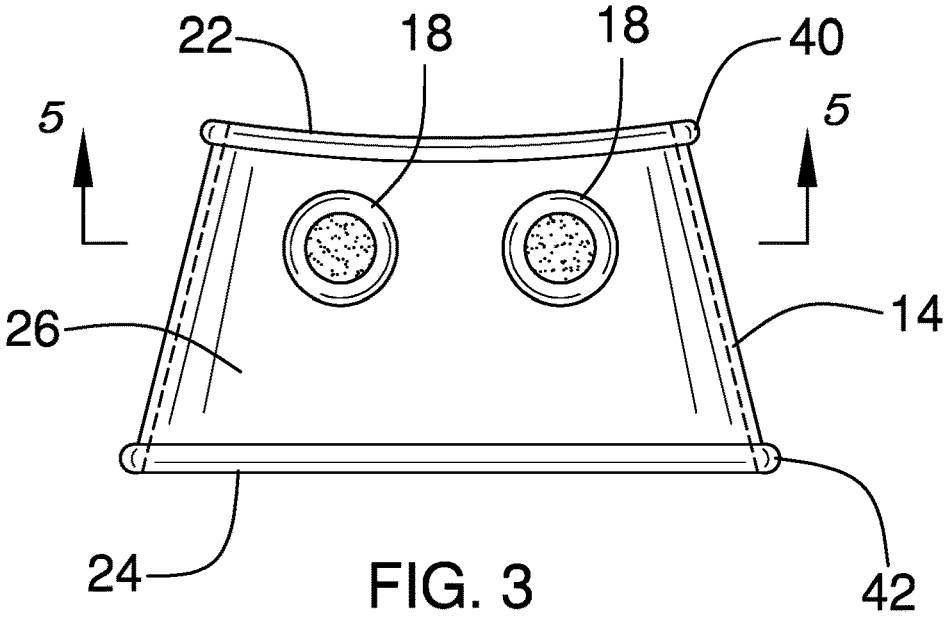
FIG. 3 is a top view of an embodiment of the disclosure.
Figure 4:
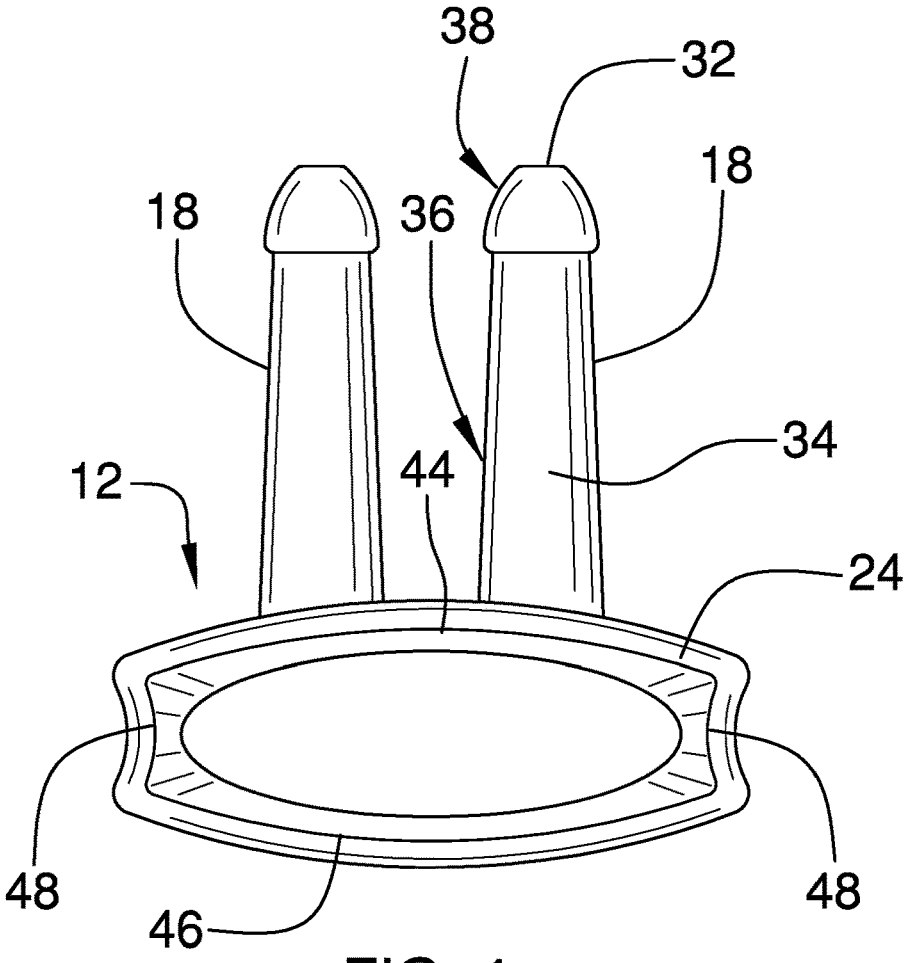
FIG. 4 is a back view of an embodiment of the disclosure.
Figure 5:
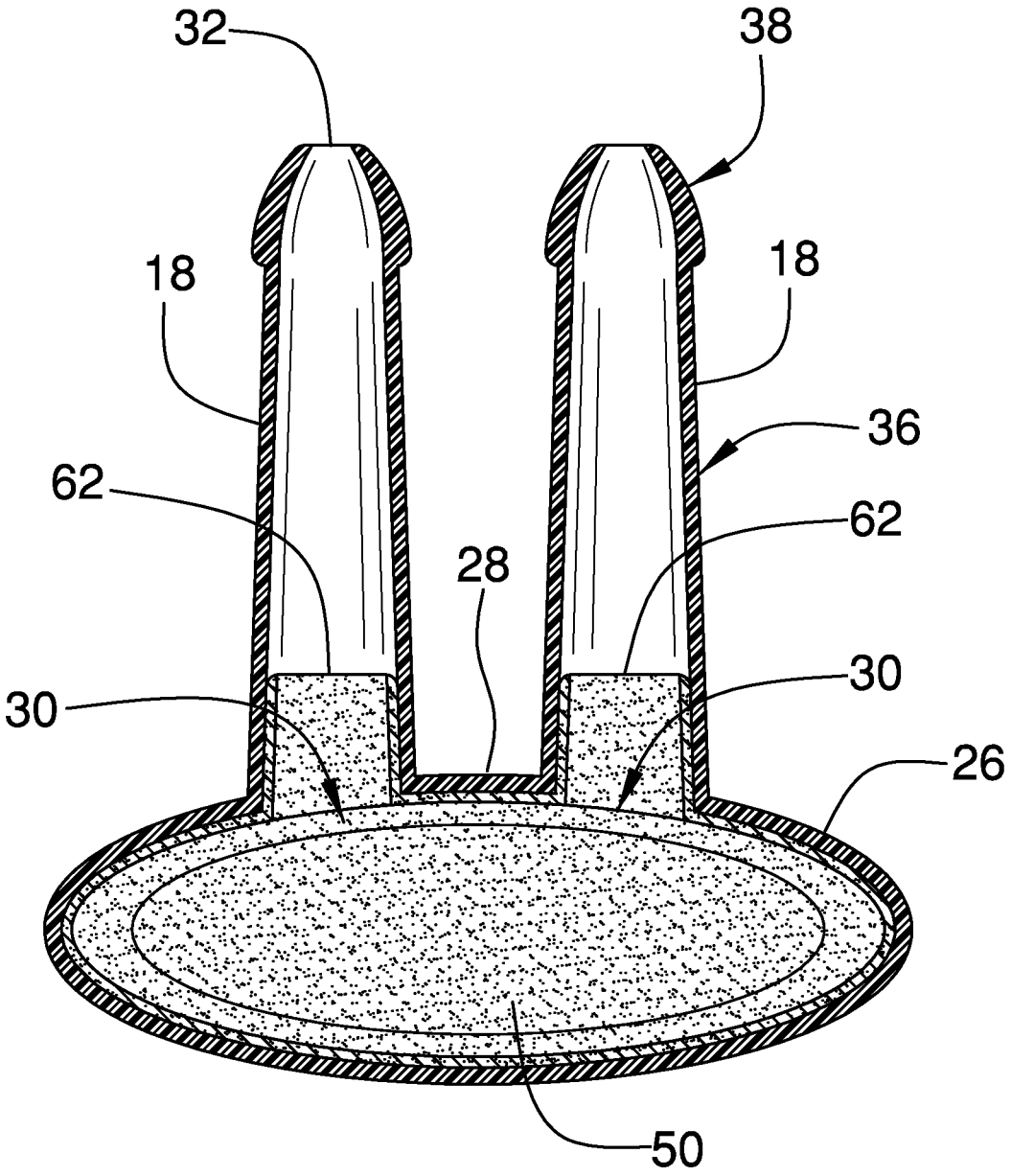
FIG. 5 is a cross sectional view taken along line 5-5 of FIG. 3 of an embodiment of the disclosure.

With reference now to the drawings, and in particular to FIGS. 1 through 7 thereof, a new breathing device embodying the principles and concepts of an embodiment of the disclosure and generally designated by the reference numeral 10 will be described.

As best illustrated in FIGS. 1 through 7, the breathing filter assembly 10 generally comprises a breathing unit 12 which includes a mouthpiece 14 that can be placed in a user's mouth 16. Additionally, the breathing unit 12 includes a pair of nose tubes 18 that can each be positioned in a respective one of the user's nostrils 20 when the mouthpiece 14 is positioned in the user's mouth 16. The user may be an industrial worker in a polluted environment, a person that has a respiratory condition that is sensitive to dust and pollen, or any other user that has a need to filter the air that they are breathing.

The mouthpiece 14 has a front end 22, a back end 24 and an outer wall 26 extending therebetween, and each of the front end 22 and the back end 24 is open to pass air therethrough when the back end 24 is positioned in the user's mouth 16. The outer wall 26 has a top side 28, the mouthpiece 14 is hollow and the top side 28 has a pair of openings 30 each extending into an interior of the mouthpiece 14. Each of the openings 30 is aligned with an axis that is oriented parallel to the front end 22 of the mouthpiece 14. Moreover, each of the openings 30 is positioned closer to the front end 22 than the back end 24, and the outer wall 26 may narrow between the back end 24 and the front end 22.

Each of the nose tubes 18 is coupled to and extends upwardly from the top side 28 of the mouthpiece 14. Each of the nose tubes 18 is aligned with a respective one of the openings 30 in the top side 28 such that each of the nose tubes 18 is in fluid communication with the interior of the mouthpiece 14. Additionally, each of the nose tubes 18 has a distal end 32 with respect to the top side 28 and an outer surface 34. The outer surface 34 of each of the nose tubes 18 has a stem portion 36 and a head portion 38, and the head portion 38 has a diameter that is greater than a diameter of the stem portion 36. In this way the head portion 38 can form a seal with the respective nostril 20 when the nose tubes 18 are inserted into the nostrils 20. Thus, the head portion 38 enhances the user's ability to breathe through their nose via the breathing unit 12.

The outer wall 26 of the mouthpiece 14 has a first lip 40 extending outwardly therefrom. The first lip 40 is aligned with the front end 22 and extends around a full perimeter of the front end 22. Additionally, the outer wall 26 of the mouthpiece 14 has a second lip 42 extending outwardly therefrom. The second lip 42 is aligned with the back end 24 and extends around a full perimeter of the back end 24.

The front end 22 is oblately arcuate about an axis extending through the front end 22 and the back end 24 to enhance fitting into the user's mouth 16. The back end 24 has an upper edge 44, a lower edge 46 and a pair of outer edges 48 extending therebetween such that the back end 24 has a rectangular shape. Each of the upper edge 44 and the lower edge 46 is concavely arcuate with respect to each other. Additionally, each of the outer edges 48 is convexly arcuate with respect to each other. The mouthpiece 14 may have a length of at least 1.0 inch and a width of at least 1.5 inches. Each of the nose tubes 18 may have a length of at least 1.5 inches and a diameter sufficient to snugly fit into nostrils 20.

A filter 50 is provided and the filter 50 is removably insertable into the breathing unit 12. The filter 50 is comprised of an air permeable material to pass air therethrough for breathing. Additionally, the filter 50 extends into the mouthpiece 14 and each of the nose tubes 18 for filtering air inhaled through the user's mouth 16 or the user's nose. The filter 50 has a rear end 52 and a perimeter wall 54 extending away therefrom, and the perimeter wall 54 has a distal edge 56 with respect to the rear end 52 defining an opening 58 into the filter 50.

The perimeter wall 54 has an outer surface 60 and the outer surface 60 has a pair of plugs 62 each extending upwardly therefrom. Each of the plugs 62 is aligned with an axis oriented parallel to the rear end 52 of the filter 50 and each of the plugs 62 is positioned closer to the rear end 52 than the distal edge 56. Each of the plugs 62 extends upwardly into a respective one of the nose tubes 18 when the filter 50 is inserted into the mouthpiece 14. The filter 50 may be comprised of charcoal, a HEPA material or any other suitable material for filtering air for breathing. The filter 50 may have a length of approximately 1.0 inch and a width of approximately 1.5 inches. Additionally, each of the plugs 62 may have a length of approximately 0.5 inches.

Figure 6:
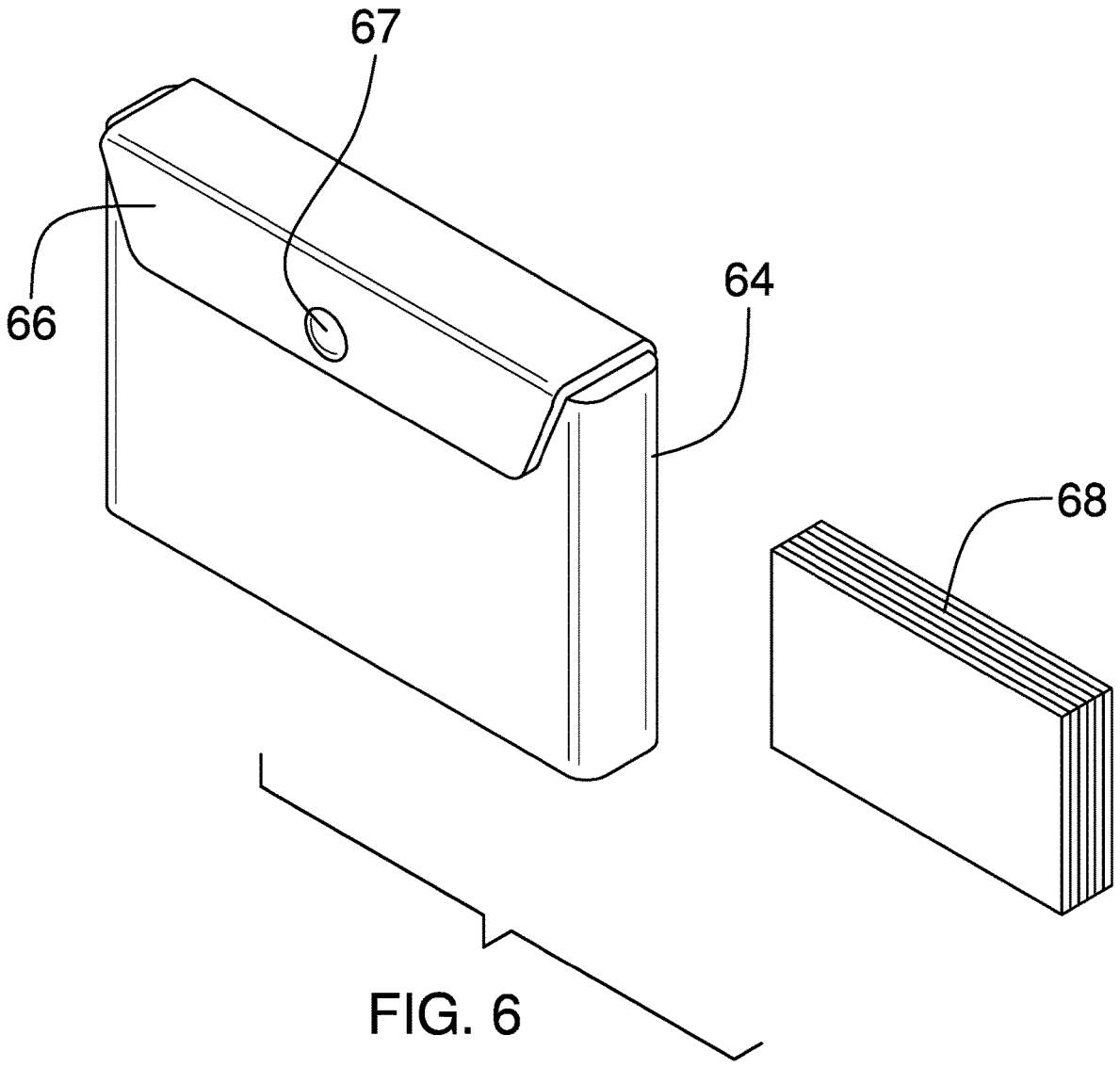
FIG. 6 is a perspective view of a carrying case and disinfecting wipes of an embodiment of the disclosure.
Figure 7:
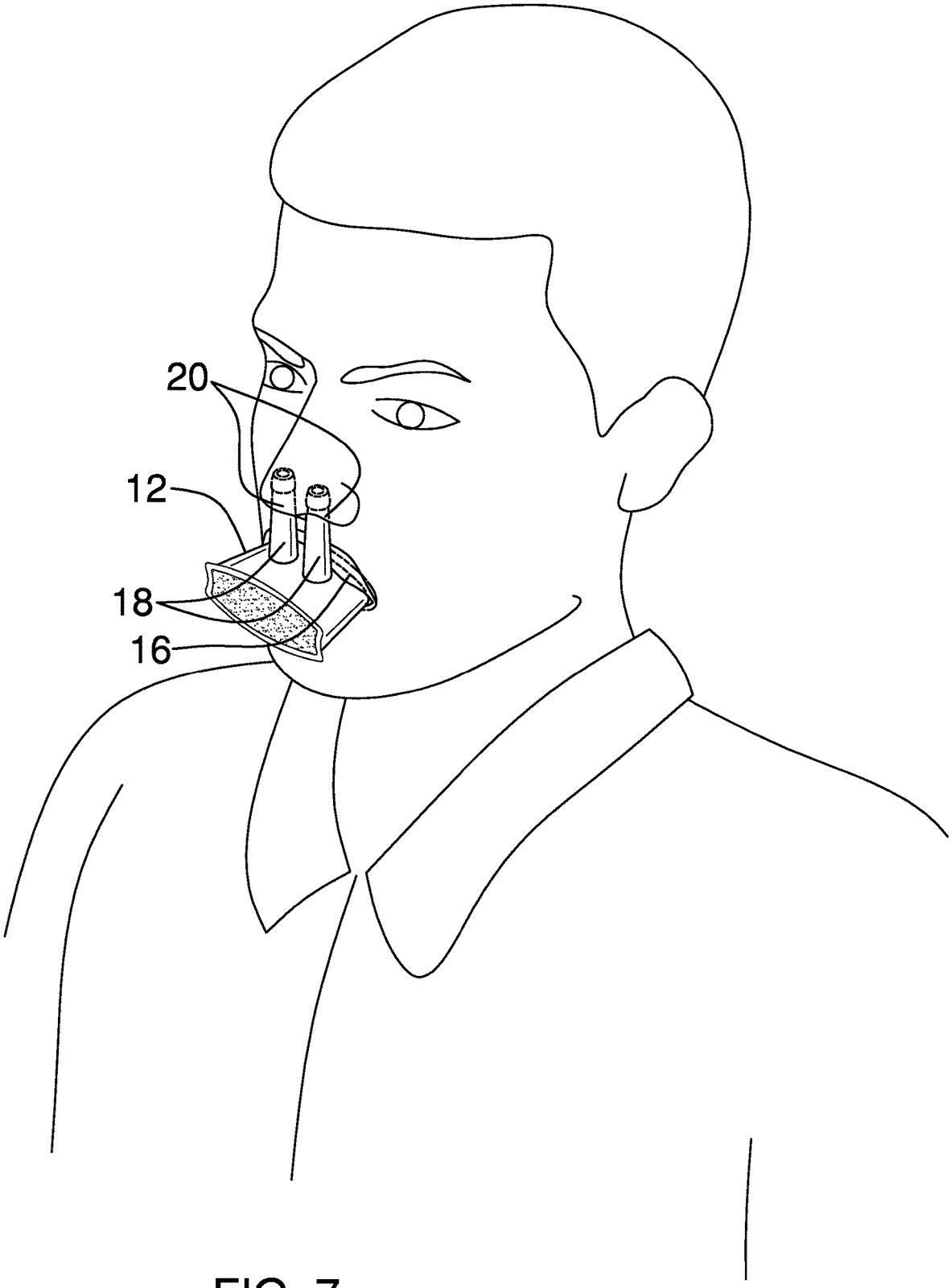
FIG. 7 is a perspective in-use view of an embodiment of the disclosure.

As is most clearly shown in FIG. 6, a carrying case 64 may be provided that has a flap 66 for closing the carrying case 64. The flap 66 may have a closure 67 thereon for releasably engaging the carrying case 64 to retain the flap 66 in a closed position. A plurality of disinfecting wipes 68 is provided and each of the disinfecting wipes 68 is infused with a chemical disinfectant for cleaning and disinfecting objects. Additionally, the disinfecting wipes 68 are stored in the carrying case 64 for storing and for transporting the disinfecting wipes 68.

In use, the filter 50 is inserted into the mouthpiece 14 such that each of the plugs 62 extends into the respective nose tube 18 and the rear end of the filter is aligned with the back end 24. The back end 24 of the mouthpiece 14 is placed in the user's mouth 16 and each of the nose tubes 18 is inserted into the respective nostril 20. In this way the filter 50 can filter the air breathed by the user through the user's mouth 16 and through the user's nose. The filter 50 can be removed and replaced when the filter 50 becomes soiled. Additionally, the disinfecting wipes 68 can be employed for cleaning the mouthpiece 14, the nose tubes 18 and any other object.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A breathing filter assembly for filtering air for breathing, said assembly comprising:

a breathing unit including a mouthpiece wherein said mouthpiece is configured to be placed in a user's mouth, said breathing unit including a pair of nose tubes wherein each of said nose tubes is configured to be positioned in a respective one of the user's nostrils when said mouthpiece is positioned in the user's mouth;

a filter being removably insertable into said breathing unit, said filter being comprised of an air permeable material wherein said filter is configured to pass air therethrough for breathing, said filter extending into said mouthpiece and each of said nose tubes wherein said filter is configured to filter air inhaled through the user's mouth or the user's nose; and wherein said filter has a rear end and a perimeter wall extending away therefrom, said perimeter wall having a distal edge with respect to said rear end defining an opening into said filter, said perimeter wall having an outer surface, said outer surface having a pair of plugs each extending upwardly therefrom.

2. The assembly according to claim 1, wherein said mouthpiece has a front end, a back end and an outer wall extending therebetween, each of said front end and said back end being open wherein said mouthpiece is configured to pass air therethrough when said back end is positioned in the user's mouth, said outer wall having a top side, said mouthpiece being hollow.

3. The assembly according to claim 2, wherein said top side has a pair of openings each extending into an interior of said mouthpiece, each of said openings being aligned with an axis being oriented parallel to said front end of said mouthpiece, each of said openings being positioned closer to said front end than said back end.

4. The assembly according to claim 3, wherein each of said nose tubes is coupled to and extends upwardly from said top side of said mouthpiece, each of said nose tubes being aligned with a respective one of said openings in said top side such that each of said nose tubes is in fluid communication with said interior of said mouthpiece, each of said nose tubes having a distal end with respect to said top side and an outer surface.

5. The assembly according to claim 4, wherein said outer surface of each of said nose tubes has a stem portion and a head portion, said head portion having a diameter being greater than a diameter of said stem portion wherein said head portion is configured to form a seal with the respective nostril when said nose tubes are inserted into the nostrils thereby enhancing the user's ability to breathe through their nose via said breathing unit.

6. The assembly according to claim 2, wherein said outer wall of said mouthpiece has a first lip extending outwardly therefrom, said first lip being aligned with said front end and extending around a full perimeter of said front end.

7. The assembly according to claim 6, wherein said outer wall of said mouthpiece has a second lip extending outwardly therefrom, said second lip being aligned with said back end and extending around a full perimeter of said back end.

8. The assembly according to claim 2, wherein said front end is oblately arcuate about an axis extending through said front end and said back end.

9. The assembly according to claim 2, wherein said back end has an upper edge, a lower edge and a pair of outer edges extending therebetween such that said back end has a rectangular shape, each of said upper edge and said lower edge being concavely arcuate with respect to each other, each of said outer edges being convexly arcuate with respect to each other.

10. The assembly according to claim 1, wherein each of said plugs is aligned with an axis oriented parallel to said rear end of said filter, each of said plugs being positioned closer to said rear end than said distal edge, each of said plugs extending upwardly into a respective one of said nose tubes when said filter is inserted into said mouthpiece.

11. A breathing filter assembly for filtering air for breathing, said assembly comprising:

a breathing unit including a mouthpiece wherein said mouthpiece is configured to be placed in a user's mouth, said breathing unit including a pair of nose tubes wherein each of said nose tubes is configured to be positioned in a respective one of the user's nostrils when said mouthpiece is positioned in the user's mouth, said mouthpiece having a front end, a back end and an outer wall extending therebetween, each of said front end and said back end being open wherein said mouthpiece is configured to pass air therethrough when said back end is positioned in the user's mouth, said outer wall having a top side, said mouthpiece being hollow, said top side having a pair of openings each extending into an interior of said mouthpiece, each of said openings being aligned with an axis being oriented parallel to said front end of said mouthpiece, each of said openings being positioned closer to said front end than said back end, each of said nose tubes being coupled to and extending upwardly from said top side of said mouthpiece, each of said nose tubes being aligned with a respective one of said openings in said top side such that each of said nose tubes is in fluid communication with said interior of said mouthpiece, each of said nose tubes having a distal end with respect to said top side and an outer surface, said outer surface of each of said nose tubes having a stem portion and a head portion, said head portion having a diameter being greater than said stem portion wherein said head portion is configured to form a seal with the respective nostril when said nose tubes are inserted into the nostrils thereby enhancing the user's ability to breathe through their nose via said breathing unit, said outer wall of said mouthpiece having a first lip extending outwardly therefrom, said first lip being aligned with said front end and extending around a full perimeter of said front end, said outer wall of said mouthpiece having a second lip extending outwardly therefrom, said second lip being aligned with said back end and extending around a full perimeter of said back end, said front end being oblately arcuate about an axis extending through said front end and said back end, said back end having an upper edge, a lower edge and a pair of outer edges extending therebetween such that said back end has a rectangular shape, each of said upper edge and said lower edge being concavely arcuate with respect to each other, each of said outer edges being convexly arcuate with respect to each other; and a filter being removably insertable into said breathing unit, said filter being comprised of an air permeable material wherein said filter is configured to pass air therethrough for breathing, said filter extending into said mouthpiece and each of said nose tubes wherein said filter is configured to filter air inhaled through the user's mouth or the user's nose, said filter having a rear end and a perimeter wall extending away therefrom, said perimeter wall having a distal edge with respect to said rear end defining an opening into said filter, said perimeter wall having an outer surface, said outer surface having a pair of plugs each extending upwardly therefrom, each of said plugs being aligned with an axis oriented parallel to said rear end of said filter, each of said plugs being positioned closer to said rear end than said distal edge, each of said plugs extending upwardly into a respective one of said nose tubes when said filter is inserted into said mouthpiece.

* * * * *